United States Patent [19]

Kubelka

[11] 3,931,982

[45] Jan. 13, 1976

[54] RELEASE BINDING FOR SKIS

[75] Inventor: Axel Kubelka, Vienna, Austria

[73] Assignee: Gertsch AG, Zug, Switzerland

[22] Filed: June 6, 1974

[21] Appl. No.: 476,878

[30] Foreign Application Priority Data

June 7, 1973 Austria ..... 4999/73

[52] U.S. Cl. ..... 280/11.35 D; 36/2.5 AL

[51] Int. Cl.[2] ..... A63C 9/086

[58] Field of Search ..... 280/11.35 R, 11.35 K, 11.35 M, 280/11.35 D, 11.35 N, 11.35 T, 11.36; 36/2.5 AL

[56] References Cited

UNITED STATES PATENTS

| | | | |
|---|---|---|---|
| 2,669,459 | 2/1954 | Fleming | 280/11.35 R |
| 3,695,623 | 10/1972 | Covini | 280/11.35 D |
| 3,747,235 | 7/1973 | Post | 36/2.5 AL |
| 3,753,571 | 8/1973 | Gertsch et al. | 280/11.35 K |
| 3,794,339 | 2/1974 | Smolka | 280/11.35 M |

FOREIGN PATENTS OR APPLICATIONS

| | | | |
|---|---|---|---|
| 1,959,022 | 6/1970 | Germany | 280/11.36 |

*Primary Examiner*—Leo Friaglia
*Assistant Examiner*—David M. Mitchell
*Attorney, Agent, or Firm*—Woodhams, Blanchard & Flynn

[57] ABSTRACT

Safety release ski binding. There is here disclosed a release binding for skis in which the force required to effect a release is modulated in response to the relative angular position of the leg of the skier with respect to the longitudinal line of the ski. In the several embodiments shown, a resiliently backed device is provided in the usual manner for releasably holding a ski boot onto a ski, such device effecting release when a predetermined stress is applied for moving the ski boot relative to the ski. A further device is affixed either directly to the leg of the skier or to the upper part of the boot for detecting a longitudinal angular movement of the skier's leg with respect to the ski which device then diminish from a central position, corresponding to a central angular position of the skier's foot or leg, the tension on the above-mentioned resilient holding device. Thus, in a central position, the force required for release is at maximum. As, however, the skier's leg moves toward either a forward or backward limit position, such spring tension is reduced and the force required to effect release is also reduced.

13 Claims, 4 Drawing Figures

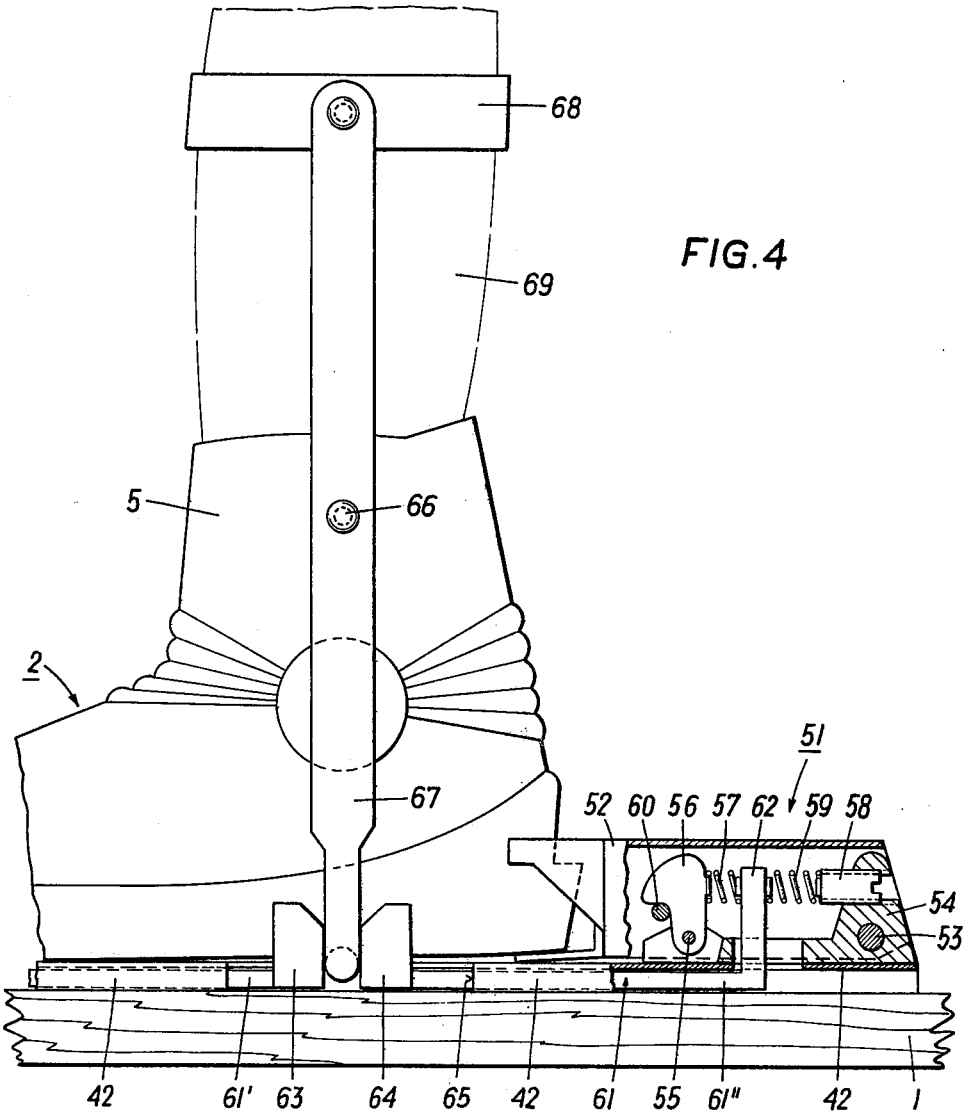
FIG.4
FIG.3
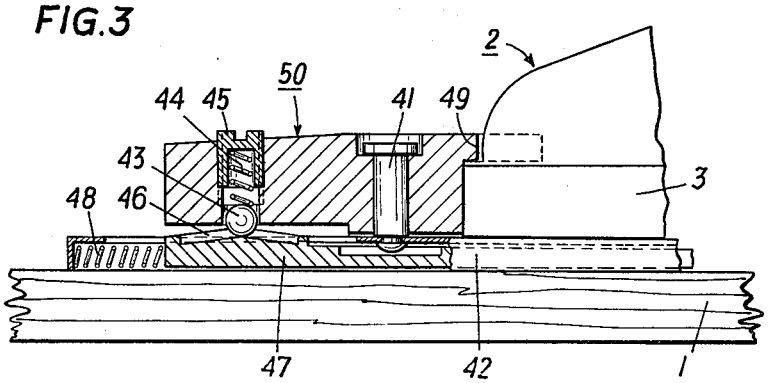

RELEASE BINDING FOR SKIS

FIELD OF THE INVENTION

The invention relates to a release binding for skis, in which holding means for either the heel or the tip of the ski boot are provided, and especially to such a binding in which the holding means each includes a locking member subjected to a holding spring and each locking member engages an abutment by a frictional connection which can be overcome.

BACKGROUND OF THE INVENTION

In known release ski bindings of this type, the holding spring, having adjustable pre-tension, has sufficient holding power normally to hold the ski boot in the binding and thus on the ski. This holding power is usually of virtually constant magnitude. As soon as the ski boot receives a stress through the lower leg portion or ankle or foot of the skier, which stress occurs for example due to a fall, and is able to overcome the holding force, the binding releases and sets the ski boot free.

Lately more release bindings have become known in which the release takes place substantially independent of, or dependent only to a predetermined degree upon, the type or the direction of the stress which the boot experiences. Thus, an important step in the direction of an ideal safety ski binding has already been taken in which — the correct adjustment of the holding spring or springs being assumed — the desired goal consists in offering a high level of security against breaks because of excessive stress on the skier's legs during skiing.

In the same direction are devices which bring the release, namely the overcoming of the holding force, into a selectable relationship to the time pattern by which the stress is applied to the ski boot. This direction of development prevents a release in the case of suddenly rising and immediately falling stress, even though the peak value is of itself sufficient to overcome the holding force. Especially in the case of high speed skiing, and the hard and quick impacts onto the ski which inevitably result therefrom, it is possible with this type of construction to prevent a premature and undesired release of the binding, it being well known that the premature and undesired release of the ski binding also often leads to falls and to resultant injuries.

The known release ski bindings, however, do not consider certain anatomical realities of the human legs. These are comparable — expressed in a greatly simplified manner — with a jointed linkage, in which between the individual link members (bones) there are provided joints (bone joints held together by ligaments), which permit a pivoting and also somewhat of a folding of the link members with respect to one another.

The natural movability of the bones with respect to one another is limited by two natural limit positions. Upon exceeding these limit positions injuries occur, for example, pulling of ligament pullings and breaking of joints, joint members or bones.

Especially in the area of the foot angle system which during skiing is probably stressed the most aside from the knee or hip joint, it is important which instantaneous position the foot joint system occupies when a possibly serious stress occurs. In other words: If the joint is, because of an intended position or because of a position existing because of the skiing position, near one limit position with respect to twisting and/or inclination of the lower leg portion in relation to the foot, a considerably small extra stress in direction of the limit position is sufficient to cause an injury. However, if the joint is approximately in a central position between the limit positions, then such a stress does not cause danger of injury because the foot can still yield.

Accordingly the purpose of the invention is to produce a release ski binding of the above-discussed type which takes into account the aforementioned facts in that the holding force receives an anticipatory control which depends upon the respective position of the foot joint system. This results in that the closer the foot joint system comes to one of its natural limit positions, the more is reduced the stress which is required for overcoming the holding force.

SUMMARY OF THE INVENTION

This purpose is attained according to the invention in the suggested release ski binding by providing a transfer mechanism, for example an articulated rocker arm, a key lever or a Bowden wire, which can be operated directly by the leg and/or the ankle of the skier or can be operated indirectly through the ski boot or the like and which is coupled with the holding spring, the locking member and/or the abutment.

With the inventive construction, the safety ski binding is controlled in a manner corresponding to the actual stresses through the direct control through the leg or ankle of the skier or through the indirect control through the ski boot or the like of the same. With this, both a premature and also a late opening of the ski binding is avoided.

A preferred embodiment of the inventive release ski binding, in which the locking members are built into the ski boot sole or into a release plate consists in that the bottom of the front and/or the rear recess for receiving such locking members is provided at the ends of a longitudinally movably supported push rod, which latter is coupled releasably to at least one articulated rocker arm supported pivotally about a horizontal axis. This embodiment permits a control through the movement of the ankle.

A different embodiment of the inventive release ski binding in which the front and the rear locking members are built into the ski boot sole or the release plate and are each supported on the one end of a pressure spring, is characterized in that the other end of the pressure spring is backed by an abutment which is supported for longitudinal movement and which is coupled releasably to at least one articulated rocker arm supported for pivoting about a horizontal axis located in the zone of the ankle.

According to a further inventive characteristic it is possible to couple the articulated rocker arm through a pivotal connection to the push rod or to the abutments.

The above-identified characteristics of the invention permit also a control through the ankle of the skier, whereby in this case various possibilities are offered for force transfer.

Thus, according to a further characteristic of the invention the articulated rocker arm can be in driving connection with an eccentric on which the push rod or the abutments are supported. This construction permits a particularly exact force transfer.

According to a still further inventive thought, the release ski binding can be used on a swivel jaw in which the locking member is a spherical surface arranged in the swingable part of the swivel jaw and the abutment includes a recess which partly receives the ball in a nonswingable part of the swivel jaw. This embodiment is characterized in that the recess is constructed in a movably supported rail which is coupled releasably to an articulated rocker arm which is supported pivotally about a horizontal axis in the zone of the ankle, wherein upon pivoting of the articulated rocker arm the depth of the recess which acts onto the spherical surface is reduced. Through this embodiment, it will be apparent that the inventive release ski binding can be used also for a swivel jaw.

According to a still further thought of the invention, the release ski binding can be used on an automatic heel clamping device, the upwardly swingable part of which is held in engaging position by a spring urged hook. For this embodiment, the hook is coupled through a push rod to an articulated rocker arm which is supported pivotally about a horizontal axis in the zone of the ankle, wherein upon pivoting of the articulated rocker arm the hook is released from its engaging position with the associated abutment.

In this case the transfer mechanism can be controlled by the leg of the skier. This arrangement is further advantageous in that the movement of the leg itself can become directly effective.

BRIEF DESCRIPTION OF THE DRAWINGS

Some exemplary embodiments and further advantages of the subject matter of the invention are discussed more in detail in connection with the drawings, in which:

FIGS. 3 and 4 are schematic longitudinal cross-sectional views of the rear or front part of a further embodiment of the inventive release ski binding with a partial side view of the ski boot.

DETAILED DESCRIPTION

Figure 1:
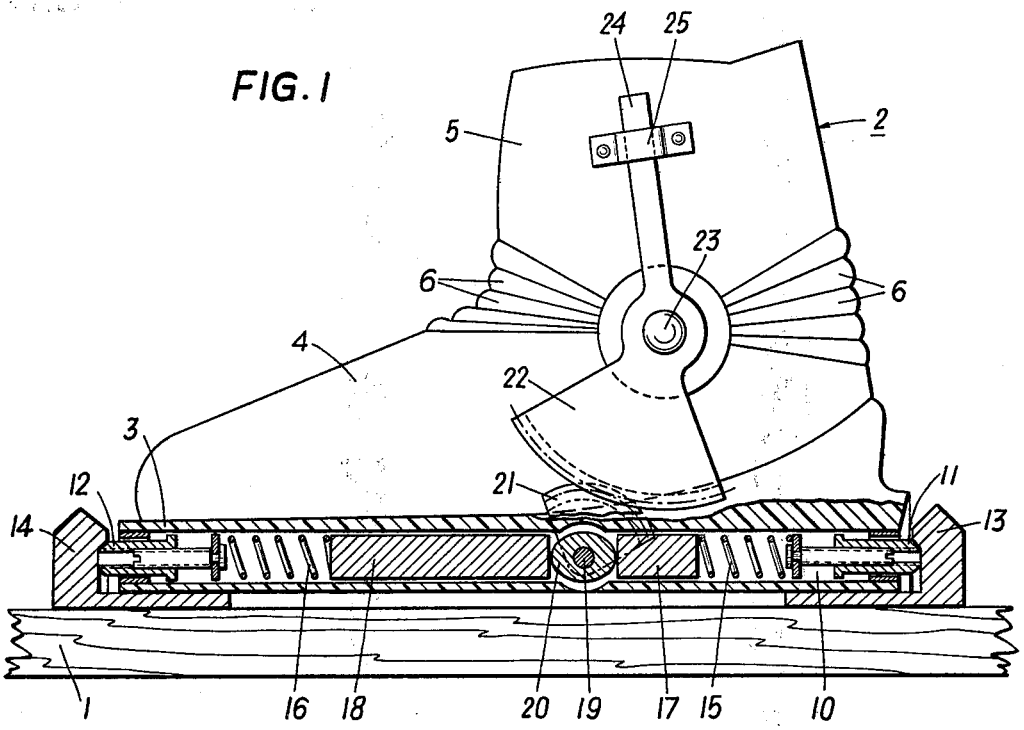
FIG. 1 is a side view of a ski boot, partly in a cross-sectional view having a schematic longitudinal cross section of an embodiment of the inventive release ski binding with transfer mechanism, in which parts of the binding are installed into the boot sole.

In the embodiment according to FIG. 1, in the sole 3 of a ski boot 2 which is mounted to a ski 1 and which has an upper leg portion 5 which is hingedly connected to the lower portion 4 through bellowslike sections 6, there is provided a longitudinal through-opening 10. From the respective ends of this through-opening extend the rear locking member 11 and the front locking member 12. The individual locking members each has, as shown in FIG. 1, two coaxial threadedly connected parts for varying the effective length of the locking members 11, 12. The conical ends of the locking members 11, 12 grip under hooklike profiled abutments 13, 14, said latter being secured to the ski 1. The inner ends of the locking members 11, 12 are supported respectively on one end of pressure springs 15 or 16 which is received in the opening 10 and the other ends of said respective pressure springs 15, 16 are respectively supported on abutment blocks 17 and 18 which are each movably supported in the opening 10. The abutment blocks 17, 18 rest on an elliptic eccentric 20, the rotatable shaft 19 of which extends horizontally and transversely to the opening 10 and also extends beyond the sole 3 at least on one side of the boot. A toothed segment 21 is fixed onto the free end of this shaft 19. This toothed segment 21 meshes with a toothed segment 22 which is supported pivotally about a pivotal axis 23 and can be rotated by means of a key lever which is constructed integrally therewith. The free end of the key lever 24 is coupled to the upper leg portion 5 by means of a bracket 25. Between the lower portion 4 and the upper leg portion 5 a device can be provided which applies a resistance against the foot movement both forwardly and backwardly. This device is for example a spring, a dampening means or the like. Such devices are already known; therefore same is not illustrated or described in detail. The counterforce which is necessary to produce the operating mode of the entire system can also be caused by a suitable design of the bellows 6.

This embodiment operates as follows: as long as the position of the user's leg does not cause any horizontal swing of the upper leg portion 5, the full prestressing force which comes from the pressure springs 15, 16 acts onto the two locking members 11, 12. However, as soon as a horizontal swing of the upper leg portion 5 takes place, either backwardly or forwardly, this swing is detected by the key lever 24 and then passed on to the toothed segment 22 as a pivotal movement at the same angle of rotation. This then causes the toothed segment 21, due to its smaller rolling circle radius, to rotate through a larger angle. This rotation is transferred onto the eccentric 20 and the abutment blocks 17, 18, in response to the action of the pressure springs 15, 16, and yield and diminish the stress on the pressure springs 15, 16. This diminishes the force urging the locking members 11, 12 resiliently under the abutments 13, 14. Thus, then a smaller stress than normal is required to release the locking members 11, 12 from the abutments 13, 14.

Figure 2:
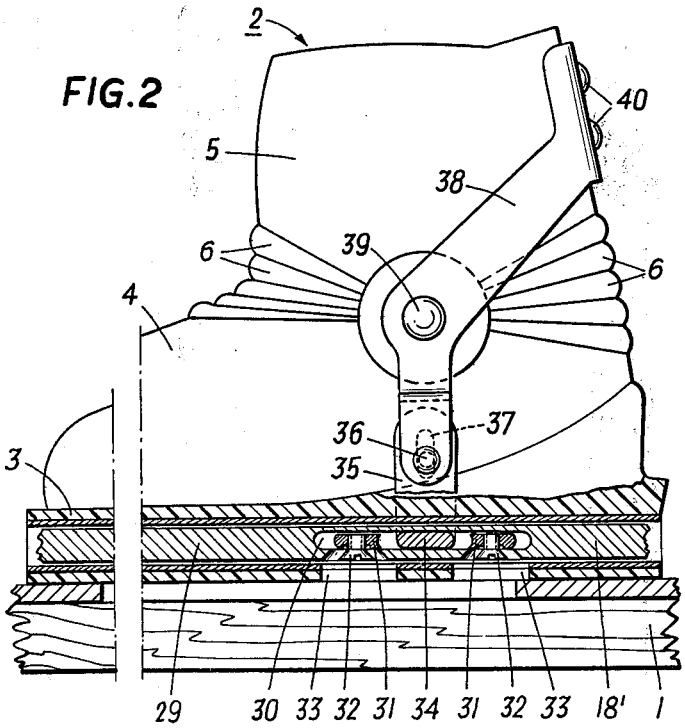
FIG. 2 is a side view and a partial cross-sectional view of a different embodiment of the transfer mechanism.

FIG. 2 illustrates a different embodiment of the transfer mechanism. The parts of the holding means for the heel or the tip of the ski boot 2, which parts are mounted on the ski 1, are in this embodiment constructed as in FIG. 1, for which reason these parts are not shown in the drawing. In this example a push rod 29 is arranged in the sole 3 of the ski boot, which push rod 29 has a laterally arranged longitudinally extending through-slot 30, the effective length of which can be adjusted by stop pieces 31. A tube 18′ which is received in the sole 3 is used in this case as a guide. The stop pieces 31 are clamped by means of screws 32 in the push rod 29, which screws are accessible through openings 33 in the sole 3 of the ski boot 2 or suitable openings in the tube 18′. The one arm 34 of an L- or U-shaped bracket 35 leads through the slot 30 which extends of course also through both sides of the tube 18′. When an L-shaped bracket is provided, then the other arm extends upwardly on the one side of the ski boot, as illustrated in FIG. 2, and when a U-shaped bracket is provided, then the two legs of this bracket extend upwardly on both sides of the ski boot 2 (not shown). The bracket 35 is at its upper free end hinged to the one arm of a rocking lever 38 by means of a pin 36 which engages through a slotted hole 37. Said rocking lever is supported pivotally on the same pivot axis 39 which is provided between the lower portion 4 and the upper leg portion 5 of the ski boot 2. The other end of the rocking lever 38 is secured on the rear part of the upper leg portion 5, for example, by means of rivets 40.

The release ski binding described in FIG. 2 operates as follows: as long as the leg of the skier is in an in-between position between the natural angular limits of the operating range, the full prestressing force is applied onto the tube 18' and, as in FIG. 1, onto the abutment blocks 17, 18. However, as soon as the leg approaches one of its end limit positions, either backwardly or forwardly, this causes a horizontal pivoting of the upper leg portion 5 which pivoting is detected by the rocking lever 38 and is transmitted onto the push rod 29 through the bracket 35 and its arm 34. This soon reaches a position in which, for example during a very strong inclination forwardly, the arm 34 encounters the rear stop piece 31. This moves the push rod 29 backwardly and automatically reduces the force applied by the associated spring. Now only a small further movement is required until the ski boot 2, even at a slightly increased prestress of the pressure spring 15, is released.

In the embodiments according to FIGS. 3 and 4, the entire ski binding — with the exception of a part of the transfer mechanism — is secured on the ski 1 and can be compared with a common ski binding having swivel jaws and automatic heel devices.

In FIG. 3 there is shown, illustrated in a simplified manner, a swivel jaw 50 which is supported pivotally about a vertically extending swivel pin 41, the lower end of which is riveted into a stand plate 42. On one side of the swivel pin 41, the suitably profiled swivel jaw 50 grips in the zone 49 over the tip of the sole 3 of the ski boot 2. On the other side, a ball 43 is supported in the swivel jaw 50, which ball is under the effect of a pressure spring 44 which is adjustable by means of a setscrew 45. Thus the prestress can be controlled. The ball 43 engages a longitudinally extending groove 46 under the action of the pressure spring 44, which groove is constructed at the front end of a push rod 47. The push rod 47 is supported longitudinally movably below the stand plate 42 and is — as will be described later — coupled with articulated rocker arms, which detect the relative position of the leg 69 (see FIG. 4) of the skier in relationship to the ski boot 2. From FIG. 3 it can be seen that the longitudinally extending groove 46 rises from its ends toward the center, so that the ball 43, depending on the position of the push rod 47 with respect to the swivel jaw 50, is under a larger or smaller prestress of the pressure spring 44. In the position illustrated in FIG. 3, the prestress of the pressure spring 44 and thus also the release moment necessary to swing the jaw 50 is at maximum. When the push rod 47 is shifted forwardly or backwardly, this release moment is reduced accordingly. The push rod 47 is supported in front by a spring 48.

FIG. 4 illustrates the transfer mechanism for controlling an automatic heel device 51. An upwardly swingable part 52 is hinged pivotally about a pin 53 on a stationary part 54 which is anchored on the stand plate 42. A hook 56 is here provided as a locking member, which hook is pivoted around an axis 55 on the stationary part 54 and which hook is hingedly connected by means of a pressure spring 57 with the bent-up end 62 of a push rod 61. The push rod 61 is guided underneath the stand plate 42 and is operatively connected to the transfer mechanism which will be described below. The other side of the bent-up end 62 of the push rod 61 receives pressure from the spring 59 which latter can be adjusted by means of an adjusting screw 58. When the ski boot 2 is clamped in place, the hook 56 grips over a pin 60 which is anchored on the part 52 and which can be swung upwardly. The profile of the hook mouth is chosen such that at an excessive stress on the hook 56 through the pin 60, the hook is pivoted against the action of the pressure spring 59 backwardly and thus immediately releases the part 52 which can be moved upwardly.

FIG. 4 further shows that the front or rear end 61' or 61'' of the push rod 61 each with a bent-up section 63 or 64 extends laterally through a slot 65 out of the stand plate 42 and upwardly. The lower end of an articulated rocker arm 67, which is pivotally supported at 66 on the upper leg portion 5, engages between said sections 63 and 64, and the upper end of said articulated rocker arm being secured directly on the leg 69 of the skier through a jointed collar 68. On the side opposite from that shown, the arrangement can be exactly the same as shown in FIG. 4. If now the articulated rocker arm 67 and/or the articulated rocker arm which is provided on the side not facing the viewer is swung in the one or in the other direction, then either the locking of the jaw 51 or the locking of the hook 56 with the web 60 is relieved and a small release moment can effect the release of the corresponding binding parts.

Due to the fact that the transfer mechanism engages directly the leg 69 of the skier, an excessive joggling or twisting of the leg in relationship to the foot will effect a loosening of the locking means even when the leg remains in the vertical line because the articulated rocker arms then swing in opposite directions.

The invention is not limited to the discussed embodiments. Instead various changes can be made without exceeding the scope of the invention. For example, the discussed transfer mechanisms and lockings can be varied among one another. However, it is also possible to use different connecting elements for the transfer mechanism. It is furthermore possible to arrange the transfer mechanism in the ski boot or to cover the outer side of the ski boot.

The embodiments of the invention in which an exclusive property or privilege is claimed are defined as follows:

1. A release ski binding, comprising: holding means for one of the heel and the toe of the ski boot, said holding means including a holding spring and a locking member operatively associated with said ski boot and biased by said holding spring into a releasable engagement with an abutment means mounted on a ski, the engagement of said locking member with said abutment means holding said ski boot to said ski, transfer means pivotally connected to said ski boot, the leg of the skier being operatively connected to move said transfer means, said transfer means including control means coupled with at least one of said abutment means and said holding spring for varying the magnitude of force required to effect a release of said ski binding in response to a movement of said leg relative to said pivot connection to thereby control the force at which a release of said ski binding will occur, whereby a movement of said leg relative to said pivot connection on said ski boot will control the magnitude of the release force required to effect a release of said ski binding.

2. The improvement according to claim 1, wherein said locking member is urged into engagement with said abutment means by said holding spring; and wherein said abutment means includes a movable locking abutment which is moved in response to a leg movement relative to said locking member.

3. The improvement according to claim 1, wherein said transfer means includes means defining a two arm lever pivotally secured to said ski boot, a first arm of said two arm lever being secured to the shaft of said ski boot, the second arm being coupled to said control means.

4. The improvement according to claim 1, wherein said abutment means includes a movable locking abutment; and wherein said control means includes a movable push rod coupled with said locking abutment, said push rod and said locking abutment being movable by said transfer means relative to said locking member of said holding means; and wherein said transfer means includes means defining a two arm lever pivotally secured to said ski boot, a first arm of said two arm lever being secured to the shaft of said ski boot, the second arm being releasably coupled to said push rod; and wherein said holding means is a pivot jaw and wherein said locking member is a ball surface arranged in a pivotal part of said pivot jaw, said locking abutment being mounted in the nonpivotal part of said pivot jaw and having a variable depth recess therein partly receiving said ball surface; and wherein upon movement of said second arm, said recess acting on said ball surface is shifted and the depth of the part of said recess in which said ball surface rests is altered to effect a lower holding force holding said pivotal part of said nonpivotal part.

5. The improvement according to claim 1, wherein said control means is coupled with said holding spring for varying the magnitude of said spring force in response to a movement of said leg relative to said pivot connection to thereby control the force at which said ski binding will effect a release of said ski boot; and wherein said locking member is urged into engagement with said abutment means by a holding spring; and wherein said control means is coupled with said holding spring and includes a movable abutment block engaging said holding spring at a location spaced from said locking member whereby said movement of said leg effects a movement of said abutment block relative to said locking member to thereby vary the magnitude of the spring force of said holding spring; and wherein said transfer means includes means defining a two arm lever pivotally secured to said ski boot, a first arm of said two arm lever being secured to the shaft of said ski boot, the second arm being releasably coupled to said abutment block; and wherein said holding means is a heel mechanism; and wherein said locking member is constructed as a hook; and wherein said second arm is coupled through said abutment block to said holding spring whereby during a movement of said second arm, the force required to release said hook from its position of engagement with the associated abutment means is varied.

6. The improvement according to claim 1, wherein said control means is coupled with said holding spring for varying the magnitude of said spring force in response to a movement of said leg relative to said pivot connection to thereby control the force at which said ski binding will effect a release of said ski boot.

7. The improvement according to claim 6, wherein said locking member is urged into engagement with said abutment means by a holding spring; and wherein said control means includes a movable abutment block engaging said holding spring at a location spaced from said locking member whereby said movement of said leg effects a movement of said abutment block relative to said locking member to thereby vary the magnitude of the spring force of said holding spring.

8. The improvement according to claim 7, wherein said ski boot has a sole thereon; and wherein said transfer means includes means defining a two arm lever pivotally secured to said ski boot, a first arm of said two arm lever being secured to the shaft of said ski boot, the second arm being coupled to said control means; and wherein said locking member is mounted on said ski boot sole and is engaged by one end of said holding spring, said movable abutment block being movable in a direction longitudinally of said ski boot in response to a movement of said leg, the pivot axis for said two arm lever extending, in the position of use, parallel to the upper side of the ski and transversely to the longitudinal direction of said ski boot.

9. The improvement according to claim 8, wherein said control means comprises a pair of gear segments.

10. The improvement according to claim 8, wherein said control means comprises a first gear segment mounted on said second arm and a shaft mounted on said ski boot sole and having a second gear segment and an eccentric mounted thereon, said second gear segment being in meshing engagement with said first gear, said eccentric engaging said abutment block and being rotatable in response to a movement of said leg to thereby vary the magnitude of said spring force.

11. A release ski binding, comprising: holding means for one of the heel and the toe of the ski boot, said holding means including a holding spring and a locking member operatively associated with said ski boot and biased by said holding spring into a releasable engagement with an abutment means mounted on a ski, the engagement of said locking member with said abutment means holding said ski boot to said ski, transfer means operatively connected between the leg of a skier and said holding means for movement with the leg, said transfer means including control means coupled with at least one of said abutment means and said holding spring for varying the magnitude of force required to effect a release of said ski binding in response to a movement of said leg relative to said ski to thereby control the force at which said ski binding will effect a release of said ski boot, whereby a movement of said leg relative to said ski will control the magnitude of the release force required to effect a release of said ski binding.

12. The improvement according to claim 11, wherein said transfer means includes means defining a two arm lever pivotally secured to said ski boot, a first arm of said two arm lever being secured to the shaft of said ski boot, the second arm being coupled to said control means.

13. The improvement according to claim 11, wherein said control means is coupled with said holding spring for varying the magnitude of said spring force in response to a movement of said leg relative to said ski to thereby control the force at which said ski binding will effect a release of said ski boot; and wherein said locking member is urged into engagement with said abutment means by a holding spring; and wherein said control means is coupled with said holding spring and includes a movable abutment block engaging said holding spring at a location spaced from said locking member whereby said movement of said leg effects a movement of said abutment block relative to said locking member to thereby vary the magnitude of the spring force of said holding spring.

* * * * *